US006672289B2

(12) United States Patent
Gau

(10) Patent No.: US 6,672,289 B2
(45) Date of Patent: Jan. 6, 2004

(54) MICRO-PULSATION FUEL INJECTION SYSTEM WITH UNDERPRESSURE STABILIZER

(75) Inventor: Tien-Ho Gau, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 97 days.

(21) Appl. No.: 10/016,803

(22) Filed: Dec. 6, 2001

(65) Prior Publication Data

US 2003/0084885 A1 May 8, 2003

(30) Foreign Application Priority Data

Nov. 5, 2001 (TW) ..... 90218895 U

(51) Int. Cl.[7] ..... F02M 37/04
(52) U.S. Cl. ..... 123/514; 123/467
(58) Field of Search ..... 123/514, 510, 123/467, 179.17, 198 D

(56) References Cited

U.S. PATENT DOCUMENTS 4,274,380 A * 6/1981 Vulpillieres ..... 123/456
4,375,206 A * 3/1983 Baltz et al. ..... 123/179.11
4,984,554 A * 1/1991 Ariga et al. ..... 123/514
5,878,724 A * 3/1999 Channing ..... 123/514
6,279,545 B1 * 8/2001 Frank et al. ..... 123/514

* cited by examiner

*Primary Examiner*—Carl S. Miller
(74) *Attorney, Agent, or Firm*—Pro-Techtor International Services

(57) ABSTRACT

A micro-pulsation fuel injection system with underpressure stabilizer, comprising a fuel supply system, a fuel tank, a micropump, and a compression pump. The micropump ejects fuel into an intake pipe. The compression pump is connected with a fuel supply pipe of the micropump, for keeping underpressure of the inlet of the micropump against the intake pipe stable. Incoming fuel passes through a fuel chamber, separated by a membrane from a pressure chamber, which in turn is connected to the intake pipe. The membrane deforms according to pressure in the intake pipe, changing volume of the fuel chamber and generating underpressure of fuel therein. Additionally, a regulating valve is installable between the compression pump and the micropump for stabilizing the difference of pressures at the inlet of the micropump and in the intake pipe. Thus the quantity of fuel ejected by the micropump is precisely controlled.

2 Claims, 8 Drawing Sheets

MICRO-PULSATION FUEL INJECTION SYSTEM WITH UNDERPRESSURE STABILIZER

BACKGROUND OF THE INVENTION

1. Field of the Invention

The present invention relates to a micro-pulsation fuel injection system with underpressure stabilizer, particularly to a micro-pulsation fuel injection system with underpressure stabilizer to be used in an internal combustion engine.

2. Description of Related Art

Conventional fuel supply systems of internal combustion engines include carburetors and fuel injection systems. A mechanical carburetor, using underpressure generated by flow in a tube, sucks in and vaporizes fuel. Vaporized fuel, having mixed with air, enters a cylinder of the internal combustion engine. However, being regulated by an inclination of an adjustment needle and flow control by the throttle valve, the quantity of fuel taken in is hard to control precisely. At full throttle, vaporization is imperfect, so that fuel wetting becomes worse.

A fuel injection system, on the other hand, has an electric fuel pump which pressurizes and pushes out fuel through a nozzle into an inlet manifold, where fuel is sprayed apart into fuel droplets. The fuel droplets subsequently mix with inlet air and enter a cylinder of the internal combustion engine. However, since fuel is ejected at high speed without being uniformly distributed, no uniform mixture of fuel and air is attained, so that fuel is wetted at walls of the intake port. Imperfect combustion of fuel results then.

Furthermore, with increasing demand for better characteristics, conventional carburetors developed to the present day have become complicated precision devices, which makes manufacturing thereof difficult and expensive. On the other hand, fuel injection systems, each requiring a fuel pump, a high-pressure pipe, a regulator, and a nozzle are complex and costly. Since operating pressure is high, sealing of pipes and of the pump requires special attention to prevent leakage. A collision or burst of the pipes will causes fuel spurt out, forming fuel vapor which is readily ignited by a spark or heat. This is a severe safety drawback.

For the reasons just given, conventional fuel supply systems have considerable shortcomings. This has brought up micro-pulsation pumps as means for supplying fuel. Therein, micropumps are placed at the intake pipe of an internal combustion engine, vaporizing and ejecting fuel into the inlet. Thus fuel which is completely mixed with air enters the cylinder. Being products of mature technology, micropumps are inexpensive. Furthermore, micropumps operate at low pressure, thus there is no need to add a pressurizing system. This keeps down costs, and there is no risk of explosion due to broken pipes. Moreover, micropumps are capable precisely to dose fuel, ejecting fuel droplets ejected at medium speed, so completely mix with air. Therefore, no wetting of walls of intake pip will occur, and combustion in the engine will be more effective.

As shown in FIG. 8, the micropump array 80 is manufactured using a micro-fabrication process, having a plurality of elements arranged in rows, with corresponding nozzles 81, 50 that tiny droplets are ejected. Thus the fluid is ejected as fine vapor and evenly distributed in the surrounding air. As shown in FIGS. 9 and 10, the micropump array 80 is a thermal tubble micropump or a piezoelectric micropump.

As shown in FIGS. 9–11, a thermal bubble micropump, which is conventional, has a substrate 90, enclosing one chamber 91 or a plurality of chambers 91, a heating plate 93 and a conduit (not shown), allowing the fluid to enter the chambers 91. Furthermore, a nozzle plate 92 is glued to the substrate 90, having one nozzle 81A or a plurality of nozzles 81A, with each nozzle 81A being connected with one of the chambers 91. When the fluid enters the chambers 91, intermittent heating of the heating plate 93 vaporizes the fluid, causing tiny droplets 95 thereof to be ejected through the nozzles 81A, so that vapor is spread in the surrounding air.

As shown in FIG. 10, a piezoelectric micropump has a substrate 100, enclosing a chamber 101 which is covered by a nozzle plate 102. The nozzle plate 102 has a nozzle 81A. A vibrating plate 103 is placed opposite to the nozzle plate 102, with a piezoelectric plate 104 being attached to the vibrating plate 103. Vibrations thereof causes tiny droplets 105 of the fluid in the chamber 101 to be ejected through the nozzle 81A.

However, since a micropump operates without valves, underpressure of incoming fuel needs to be maintained to prevent fuel from leaking from the micropump due to gravitation. Furthermore, being placed in the inlet of the engine, inlet pressure varies with operational states of the engine, with underpressure of incoming fuel varying along. This causes the quantity of fuel furthered by the micropump to vary, as well. It is therefore desirable for achieving well-defined operation of the micropump to keep the underpressure of incoming fuel stable against the pressure of air in the inlet.

SUMMARY OF THE INVENTION

The main object of the present invention is to provide a micro-pulsation fuel injection system with underpressure stabilizer which maintains a stable underpressure of an inlet of the micropump against the exterior thereof in an intake pipe of an internal combustion engine, so that fuel is precisely delivered for effective combustion thereof.

The present invention has a compression pump at a fuel supply pipe of the micropump, for keeping underpressure of the inlet of the micropump against the intake pipe stable. Incoming fuel passes through a fuel chamber, separated by a membrane from a pressure chamber, which in turn is connected to the intake pipe. The membrane deforms according to pressure in the intake pipe, changing volume of the fuel chamber and generating underpressure of fuel therein.

The present invention can be more fully understood by reference to the following description and accompanying drawings.

DETAILED DESCRIPTION OF THE PREFERRED EMBODIMENTS

Figure 1:
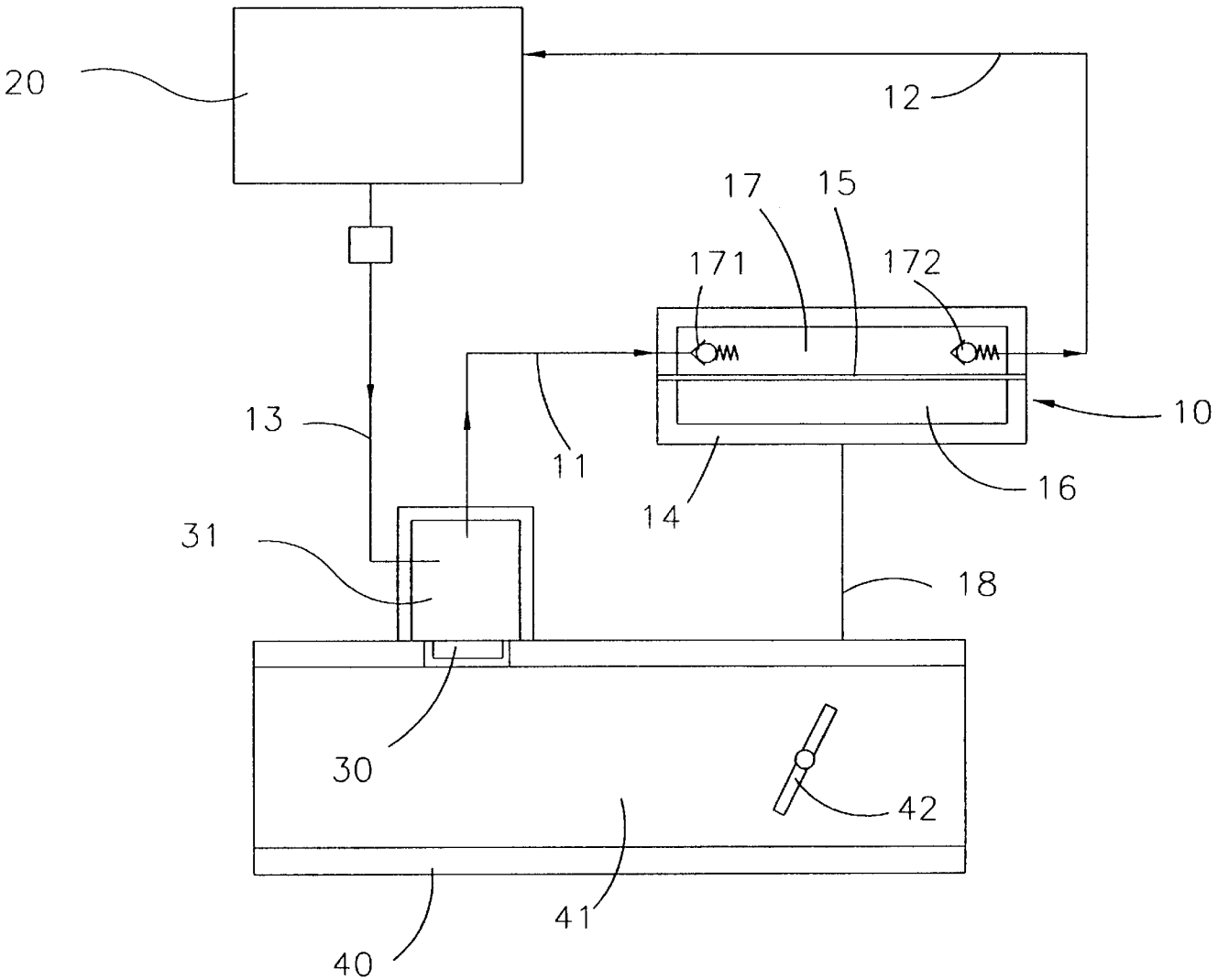
FIG. 1 is a schematic illustration of the micro-pulsation fuel injection system with underpressure stabilizer of the present invention in the first embodiment.

As shown in FIG. 1, the present invention in a first embodiment comprises: a compression pump 10; a fuel tank 20; and a micropump 30. A bypass 11 leads into the compression pump 10, and a backflow pipe 12 leads out of there. The bypass 11 and the backflow pipe 12 together with a fuel supply pipe 13 form a circuit. The fuel supply pipe 13 is connected with the fuel tank 20, with an underpressure safety valve 19 placed in between. The bypass 11 leads from the fuel supply pipe 13 to the compression pump 10. The backflow pipe 12 leads back into the fuel tank 20. With the compression pump 10 sucking in fuel from the bypass 11 and delivering fuel via the backflow pipe 12 into the tank 20, a closed loop of fuel flow is formed. The fuel supply pipe 13, being connected with the bypass 11, ends at the micropump 30. The micropump 30 is mounted at an intake pipe 40 of an internal combustion engine, ejecting tiny droplets of fuel into the intake pipe 40. The intake pipe 40 has an air canal 41, in which a throttle valve 42 is placed. The air canal 41 leads to a cylinder of the internal combustion engine, with the throttle valve 42 regulating the quantity of air passing through.

The compression pump 10 of the present invention sucks in fuel from the fuel tank 20 through the bypass 11, returning fuel through the backflow pipe 12 to the fuel tank 20, so that a closed loop is formed.

Sucking of fuel from the fuel tank 20 through the bypass 11 into the compression pump 10 generates underpressure in the fuel supply pipe 13. The supply pipe 13 is connected with an inlet 31 of the micropump 30. Therefore, underpressure is maintained at the inlet 31 of the micropump 30.

Referring again to FIG. 1, the compression pump 10 has a case 14 having an inside which is divided by a membrane 15 into a lower half and an upper half, constituting a pressure chamber 16 and a fuel chamber 17, respectively. A transmission tube 18 transmits pressure from the intake pipe 40 to the pressure chamber 16. An inlet valve 171 is mounted at an entrance of the fuel chamber 17, to which the bypass 11 is connected. An outlet valve 172 is mounted at an exit of the fuel chamber 17, to which the backflow pipe 12 is connected. The inlet valve 171 and the outlet valve 172 are one-way valves, only allowing fluid to enter the fuel chamber 17 from the bypass 11 and to leave the fuel chamber 17 through the backflow pipe 12.

Figure 2:
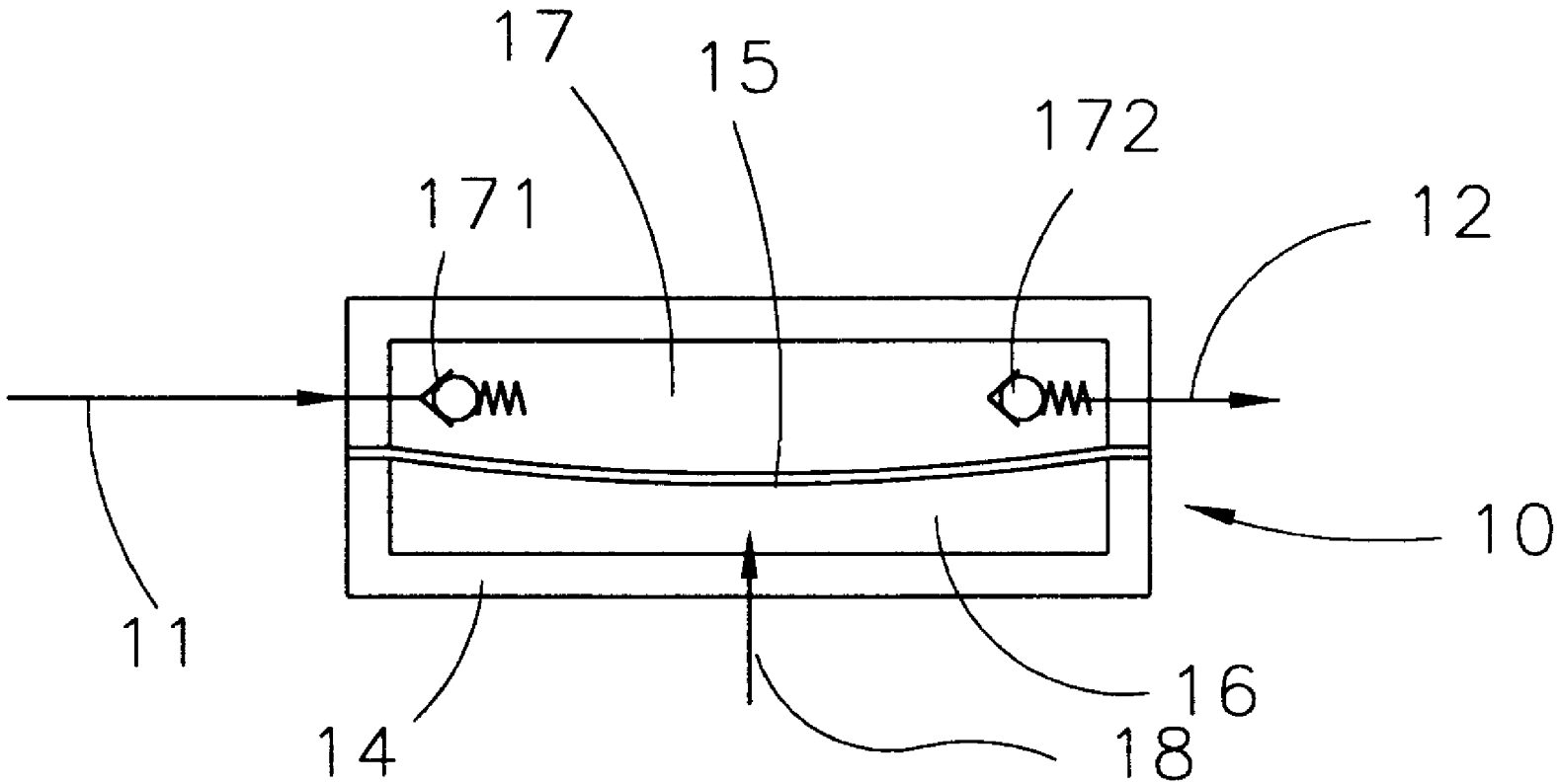
FIG. 2 is a schematic illustration of the movement of the compression pump of the present invention in the first embodiment.

Referring to FIG. 2, movement of the compression pump 10 comes about by pressure changes in the pressure chamber 16, which follow pressure changes in the intake pipe 40. Due to pressure changes in the pressure chamber 16 the membrane 15 deforms slightly and elastically, changing the volume of the fuel chamber 17. When the volume of the fuel chamber 17 increases, fuel is sucked in through the bypass 11. On the other hand, when the volume of the fuel chamber 17 decreases, fuel is pressed out through the backflow pipe 12 and flows back into the fuel tank 20.

The movement of the compression pump 10 lies in deforming of the membrane 15 caused by pressure changes in the air canal 41 of the intake pipe 40, which take away or apply pressure. When pressure is taken away and the membrane 15 consequently bends downward, the fuel chamber 17 expands, so that underpressure in the bypass 11 and in the fuel supply pipe 13 results. This causes underpressure in the inlet 31 of the micropump 30, as well. When the membrane 15 is pushed on by pressure transmitted through the transmission tube 18, the fuel chamber 17 shrinks, pressing fuel out through the backflow pipe 12.

Thus the compression pump 10 effects stable underpressure at the inlet 31 of the micropump 30. A fixed negative difference of pressures at the inlet 31 of the micropump 30 and in the intake pipe 40 is maintained, so that no fuel will leak out of the micropump 30 and no improper quantities of fuel will be ejected. Therefore, the quantity of ejected fuel is better controlled, and combustion thereof is more effective.

Figure 3:
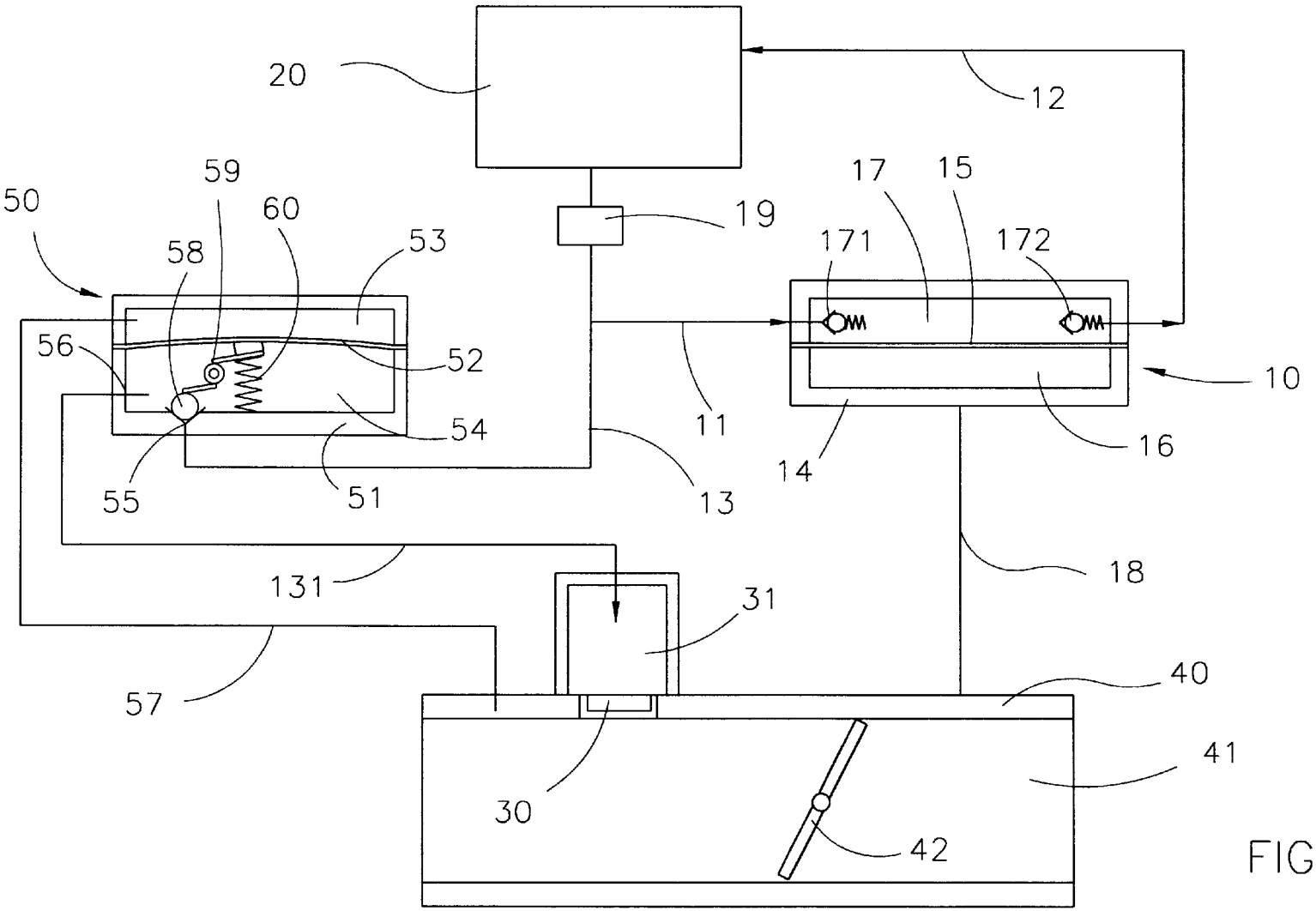
FIG. 3 is a schematic illustration of the micro-pulsation fuel injection system with underpressure stabilizer of the present invention in the second embodiment.

Referring now to FIG. 3, the present invention in a second embodiment comprises: a compression pump 10; a fuel tank 20; a micropump 30; and an intake pipe 40. The structural parts and the assembly of the present invention are the same in the first and second embodiments, except for an additional regulating valve 50 in the second embodiment. The regulating valve 50 is installed between the bypass 11 and the intake pipe 40, attenuating changes in underpressure of the bypass 11 against the intake pipe 40, so that a fixed difference is maintained between pressures at the inlet 31 of the micropump 30 and in the intake pipe 40 for better precision of ejected fuel quantity.

Figure 6:
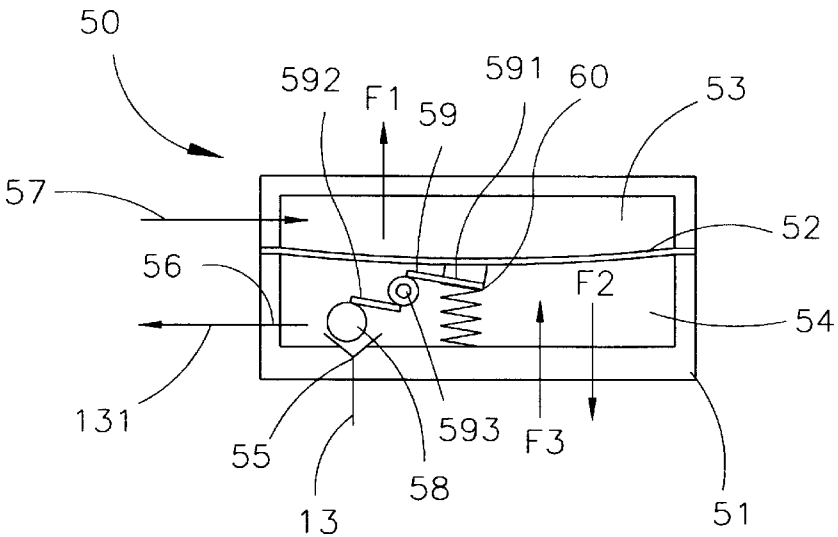
FIGS. 5 and 6 are schematic illustrations of the movement of the regulating valve of the present invention in the second embodiment.
Figure 5:
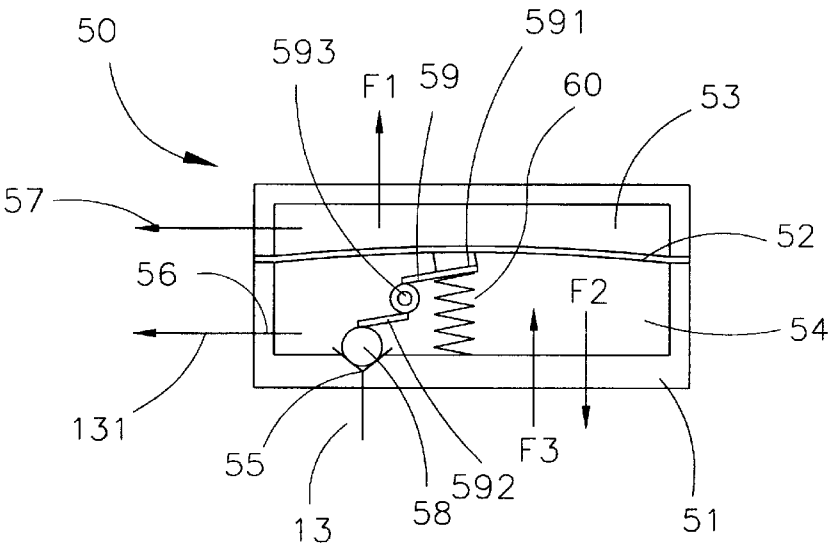

As shown in FIG. 3, the regulating valve 50 has a case 51 having an inside which is divided by a membrane 52 into an upper half and a lower half, constituting a pressure chamber 53 and a working liquid chamber 54, respectively. The working liquid chamber 54 has an inlet opening 55 which is connected with the fuel supply pipe 13, allowing fuel from the fuel tank 20 to enter the working liquid chamber 54. The working liquid chamber 54 further has an outlet opening 56 from which a secondary fuel supply pipe 131 leads to the inlet 31 of the micropump 30. The pressure chamber 53 is via a second transmission tube 57 connected with the intake pipe 40. A control valve 58 is placed at inlet opening 55 of the working liquid chamber 54, where the fuel supply pipe 13 ends. A connecting device 59 connects the control valve 58 with the membrane 52, so that the membrane 52 drives opening and closing of the control valve 58. A spring 60 acts on the control valve 58, pressing the control valve 58 tight on the inlet opening 55. As shown in FIGS. 5 and 6, the connecting device 59 comprises a first connecting rod 591, a second connecting rod 592, and a shaft 593, located between the first connecting rod 591 and the second connecting rod 592. The first connecting rod 591 contacts the membrane 52 from below and has a lower side that is pushed against by the spring 60. The second connecting rod 592 contacts the control valve 58. When the membrane 52 is deformed, the first connecting rod 591 is taken along, driving the control valve 58.

Figure 4:
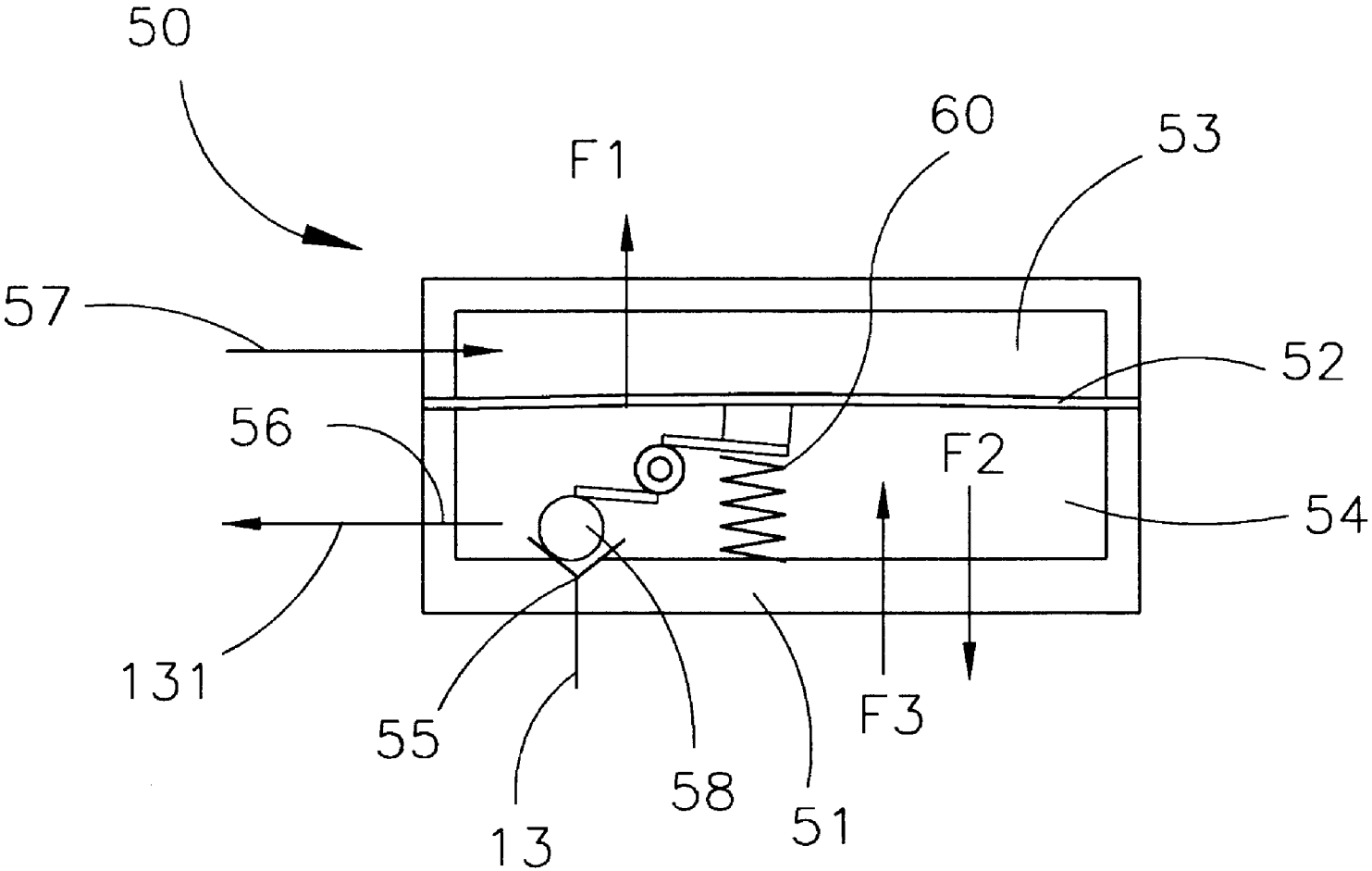
FIG. 4 is a schematic illustration of the regulating valve of the present invention in the second embodiment in a balanced state exposed to forces.

Referring to FIG. 4, being connected with the intake pipe 40 by the second transmission tube 57, underpressure in the intake pipe 40 is followed by pressure in the pressure chamber 53, generating underpressure in the pressure chamber 53, as well, which results in a force F1, as indicated by arrow F1 in the Figs. On the other hand, pressure in the working liquid chamber 54 originates at the fuel supply pipe 13. The membrane 52 in the regulating valve 50 is on both sides exposed to forces caused by underpressure: F1 from the intake pipe 40 and, acting opposite thereto, F2 in the working liquid chamber 54. In addition, a force F3 from the spring 60 acts on the membrane 52, being equally oriented as the force F1. All forces cancel each other out, creating an equilibrium state of the membrane 52, with the force F2 that is due to underpressure in the working liquid chamber 54 minus the force F3 caused by the spring 60 being oppositely equal to the force F1 that is due to underpressure in the intake pipe 40.

As shown in FIGS. 5 and 6, when the forces F1 and F3 combined exceed the force F2 due to underpressure in the intake pipe 40 and the membrane 52 consequently bends upward, following F1, the membrane 52 drives the control valve 58 to close the inlet opening 55. Then the working liquid chamber 54, having received working liquid delivered by the compression pump 10, has a pressure that is smaller than pressure at the micropump 30 by a fixed amount.

On the other hand, as shown in FIG. 6, when there is a loss of fuel due to ejection by the micropump 30, underpressure in the working liquid chamber 54 has a gradually rising value, so that the forces F1 and F3 combined become smaller than the force F2. Then the membrane 52 bends downward, opposite to the force F1, opening the control valve 58, so that working liquid from the compression pump 10 enters the working liquid chamber 54. Inflow of working liquid into the working liquid chamber 54 avoids large pressure changes when operation is started.

Thus the regulating valve 50 keeps the difference of pressures at the inlet 31 of the micropump 30 and in the intake pipe 40 at a fixed negative value, which in theory is compensated by the force F2 of the spring 60. Changes in the difference of pressures at the inlet 31 of the micropump 30 and in the intake pipe 40 are spread out over time. Therefore the quantity of fuel ejected by the micropump 30 will not become unstable due to large pressure variation differences between inlet and outlet. Ejected fuel is effectively and precisely controlled.

Comparing the first and second embodiments of the present invention, the additional regulating valve 50 of the second embodiment regulates exactly the difference of pressures at the inlet 31 of the micropump 30 and in the intake pipe 40. Any change of the pressure difference immediately drives the membrane 52 and the control valve 58 to perform compensating movements. Therefore the difference of pressures at the inlet 31 of the micropump 30 and in the intake pipe 40 is controlled within a precise range.

Figure 7:
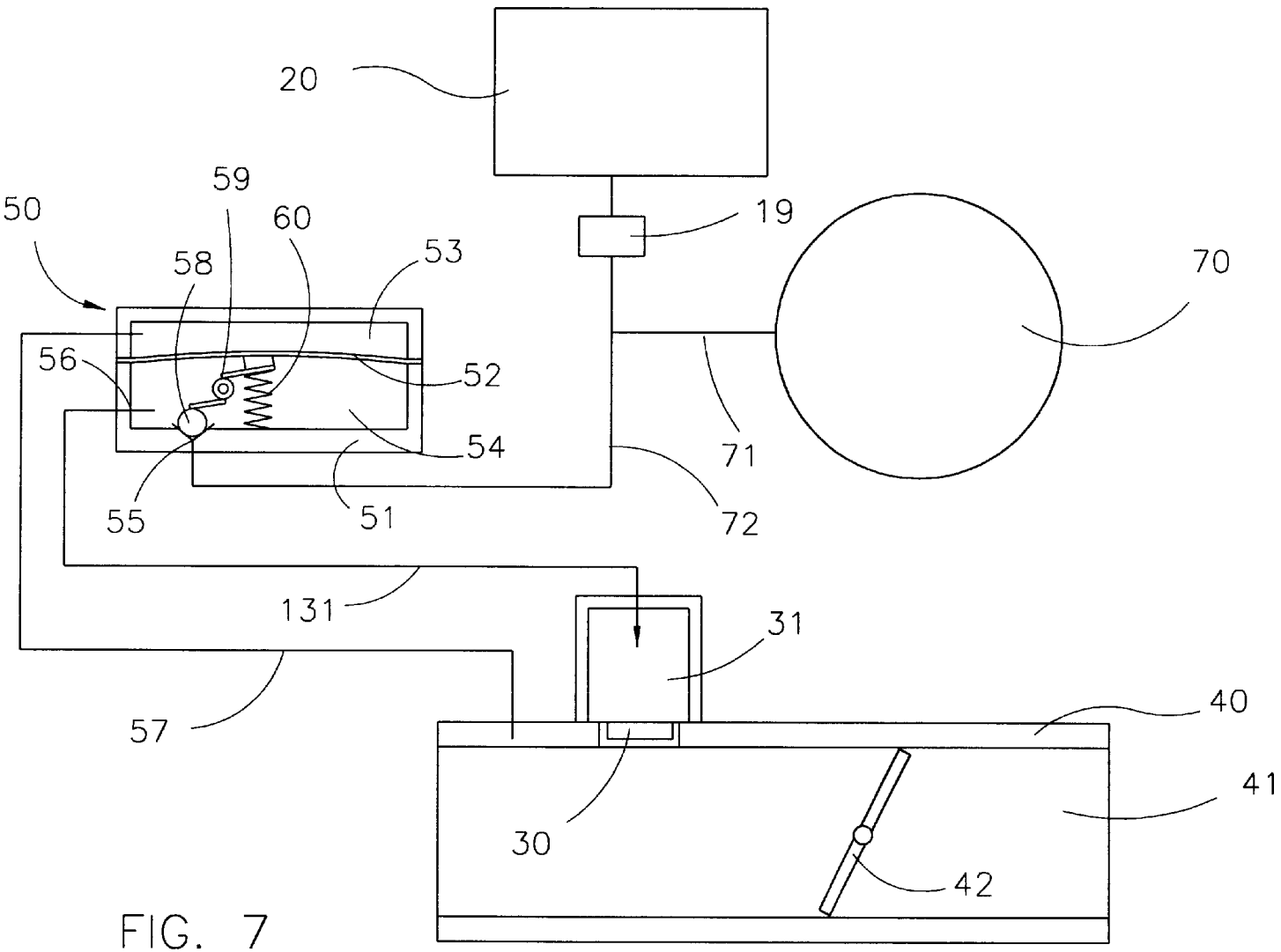
FIG. 7 is a schematic illustration of the micro-pulsation fuel injection system with underpressure stabilizer of the present invention in the third embodiment.
Figure 11:
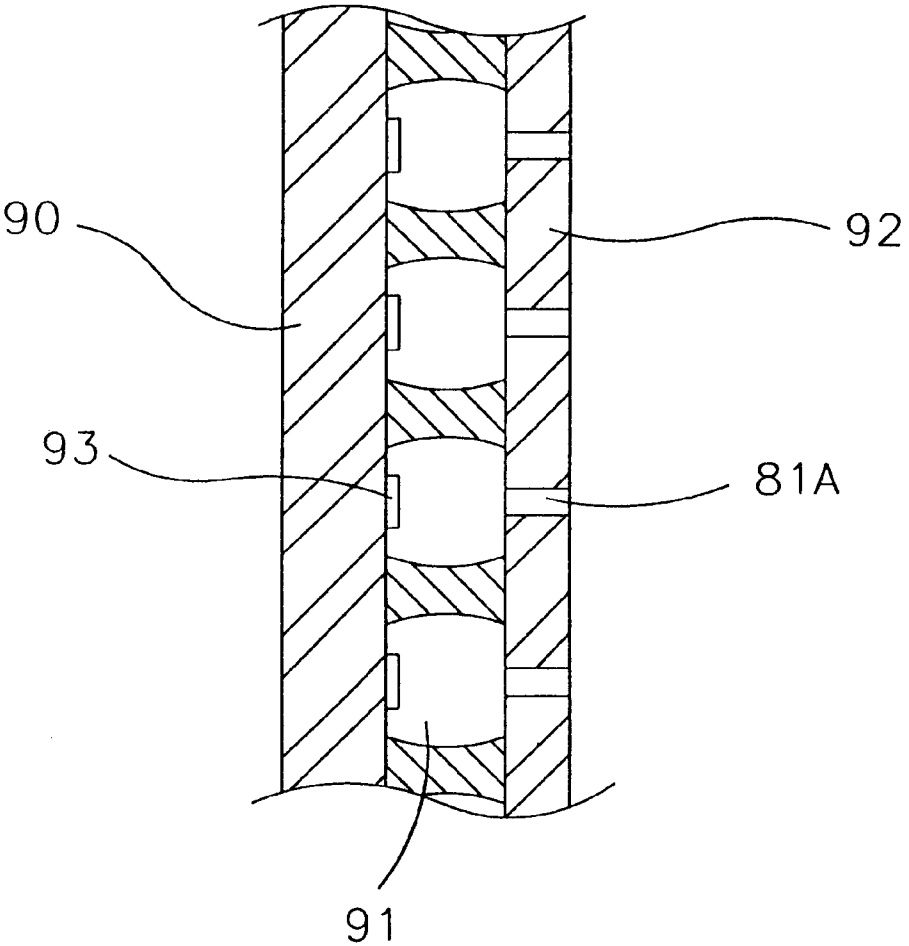
FIG. 11 is a sectional view of the micropump of the present invention, taken along line 11—11 in FIG. 8.
Figure 8:
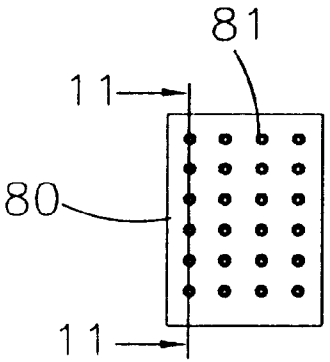
FIG. 8 is a front view of the micropump of the present invention.
Figure 10:
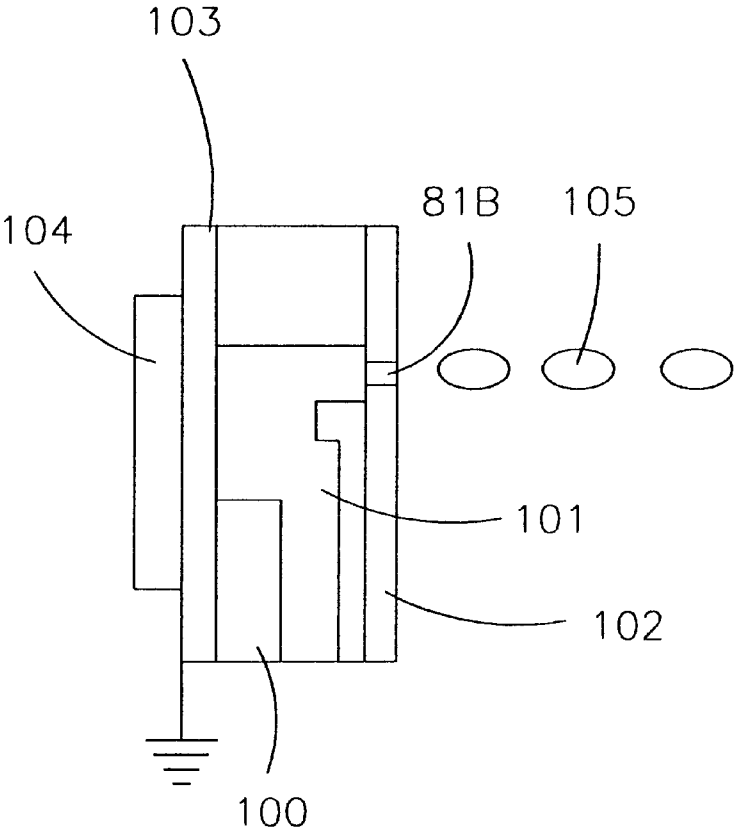
FIG. 10 is a schematic illustration of a conventional piezoelectric micropump.
Figure 9:
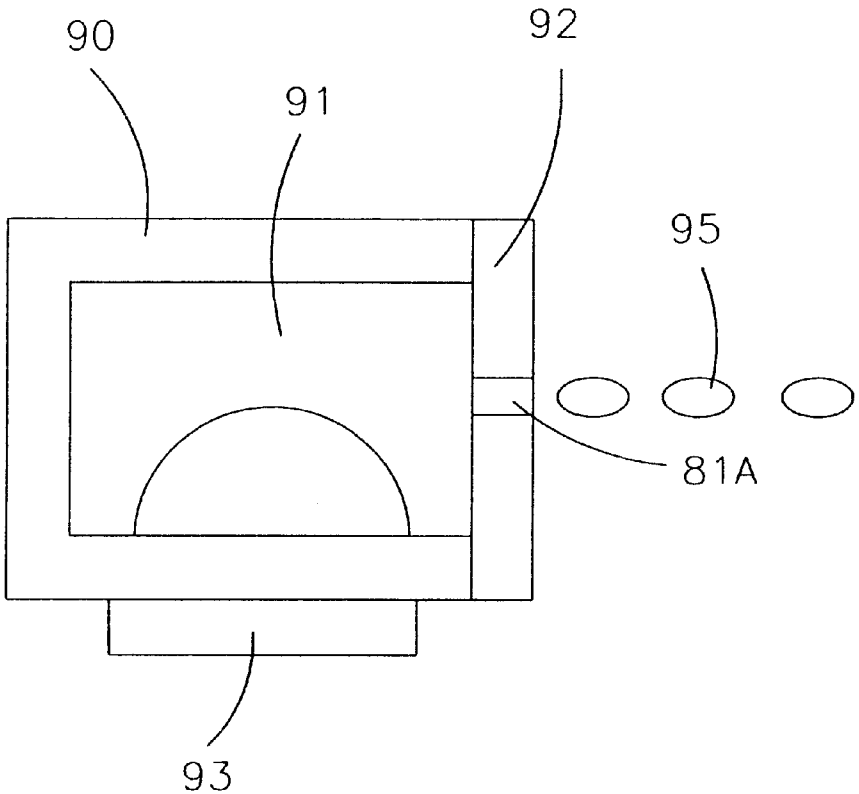
FIG. 9 is a schematic illustration of a conventional thermal bubble micropump.

The regulating valve 50 of the second embodiment is usable in conjunction with all types of pumps, not necessarily having to be combined with the compression pump 10. As shown in FIG. 7, in a third embodiment of the present invention, the regulating valve 50 is used in conjunction with a sucking pump 70. The sucking pump 70 is via a connecting pipe 71 connected with the tank 20. Fuel from the tank 20 is sucked through the connecting pipe 71, so that underpressure develops therein. A fuel supply pipe 72 branches off the connecting pipe 71, leading to the inlet opening 55 of the regulating valve 50. Thus underpressure in the working liquid chamber 54 of the regulating valve 50 is generated by the sucking pump 70. The sucking pump 70 used in this embodiment is not necessarily a micropump. Blade pumps, drum pumps or other types of pumps are usable therefor, as well.

While the invention has been described with reference to preferred embodiments thereof, it is to be understood that modifications or variations may be easily made without departing from the spirit of this invention which is defined by the appended claims.

What is claimed is:

1. A micro-pulsation fuel injection system with underpressure stabilizer, comprising:

a fuel supply system, further comprising a micropump, ejecting vaporized fuel into an intake pipe, which leads to a cylinder of an internal combustion engine, so that said vaporized fuel is taken into said cylinder;

a fuel tank, supplying fuel to an inlet of said micropump through a fuel supply pipe; and a compression pump, connected with said fuel supply pipe and generating underpressure therein;

wherein by pressure variations in said intake pipe a membrane inside said compression pump is driven to be elastically deformed, causing a change of volume of a fuel chamber, so that fuel from said fuel supply pipe is sucked in to be returned to said fuel tank via a backflow pipe, resulting in underpressure in said fuel supply pipe.

2. A micro-pulsation fuel injection system with underpressure stabilizer according to claim 1, wherein said compression pump further comprises:

a case, having an inner space which is divided by said membrane into a pressure chamber and said fuel chamber, said pressure chamber being connected with said intake pipe by a transmission tube, which transmits pressure in said intake pipe to said pressure chamber;

an inlet opening, connected with said fuel supply pipe by a bypass;

an outlet opening, connected with said fuel tank by said backflow pipe;

a first unidirectional valve at said inlet opening, allowing only flow of fuel from said bypass into said fuel chamber; and a second unidirectional valve at said outlet opening, allowing only flow of fuel from said fuel chamber into said backflow pipe.

* * * * *